US008087970B2

(12) United States Patent
Sambenedetto

(10) Patent No.: US 8,087,970 B2
(45) Date of Patent: Jan. 3, 2012

(54) TOY CONSTRUCTION SYSTEM HAVING A ROTATABLE CONNECTOR/SPINNER DEVICE

(76) Inventor: Melissa C. Sambenedetto, Niceville, FL (US)

( * ) Notice: Subject to any disclaimer, the term of this patent is extended or adjusted under 35 U.S.C. 154(b) by 1138 days.

(21) Appl. No.: 11/446,777

(22) Filed: Jun. 5, 2006

(65) Prior Publication Data

US 2007/0281578 A1 Dec. 6, 2007

(51) Int. Cl.
*A63H 33/04* (2006.01)

(52) U.S. Cl. ..... 446/102; 446/85

(58) Field of Classification Search ..... 446/102
See application file for complete search history.

(56) References Cited

U.S. PATENT DOCUMENTS 1,446,868 A * 2/1923 Baker ..... 446/126
1,746,839 A * 2/1930 Main et al. ..... 446/100
2,609,638 A * 9/1952 Lindenmeyer ..... 446/126
2,662,335 A * 12/1953 Calverley ..... 446/99
4,037,978 A * 7/1977 Connelly ..... 403/164
5,752,869 A * 5/1998 Huff ..... 446/104
5,897,417 A * 4/1999 Grey ..... 446/125
5,913,706 A * 6/1999 Glickman et al. ..... 446/97
6,264,522 B1 * 7/2001 Dickson ..... 446/120

* cited by examiner

*Primary Examiner* — Gene Kim
*Assistant Examiner* — Alyssa Hylinski
(74) *Attorney, Agent, or Firm* — Stites & Harbison PLLC; Juan Carlos A. Marquez, Esq.

(57) ABSTRACT

A toy construction system is provided that includes, in a toy construction system having a multiplicity of interconnecting members adapted for constructing a variety of projects, a rotator head device including a device housing having a conical-shaped cavity formed therein. The housing includes a plurality of female twist-lock connectors formed on the outer surface thereof, and the female connectors are adapted for attaching a first member of the toy construction system to the rotator head device housing. A rotating member, which is conical in shape and slightly smaller in size than the cavity formed in the device housing is included. The rotating member is rotatably disposed within the cavity and has a male twist-lock connector stem extending from an end thereof for connecting a second member of the toy construction system to the rotating member, whereby the first member is rotatable with respect to the second member.

8 Claims, 10 Drawing Sheets

TOY CONSTRUCTION SYSTEM HAVING A ROTATABLE CONNECTOR/SPINNER DEVICE

CROSS REFERENCE TO RELATED APPLICATION

This Patent Application relates to co-pending application Ser. No. 11/446,778, entitled TOY CONSTRUCTION SYSTEM HAVING A VARIABLE ANGLE JOINT, filed the same date hereof, and Ser. No. 11/446,776, entitled TOY CONSTRUCTION SYSTEM HAVING A COMPOUND CONNECTOR, filed the same date hereof, both by the same inventor hereof, and the disclosures thereof are incorporated herein by reference.

FIELD OF THE INVENTION

The present invention generally relates to the field of toy building systems and more particularly to an improved system including a rotatable connector adaptable for joining a variety of components that may rotate, thereby enabling the construction of a wide assortment of children's toys and projects.

BACKGROUND OF THE INVENTION

A variety of toy construction systems are available in the market today and described in numerous issued U.S. Patents. Such construction systems commonly have male and female interlocking joints for connecting the various elements together. Although a group of such construction elements can generally be interconnected in a variety of ways, such systems generally have a limitation of the connectors not readily locking in certain orientations, or becoming worn over time, thereby becoming incapable of holding a position at a desired angle.

Exemplary prior art includes U.S. Pat. No. 409,744, entitled TOY BUILDING BLOCKS, which issued Aug. 27, 1889, to A. F. C. Garben. The invention disclosed in this patent relates to building blocks designed for the amusement and instruction of children. The invention includes sphere-headed coupling blocks, which provide a universal joint between pairs of recessed blocks. The result is that any two recessed blocks may be connected in line on a curve or at any angle, and may be held together with sufficient rigidity to make any desired toy structure. A large problem with this invention is that over time the sphere-headed couplings become worn and the objects created will not hold their shape.

Another relevant prior art toy construction system is disclosed in U.S. Pat. Nos. 1,915,835 and 1,916,634, both entitled TOY CONSTRUCTION BLOCK, both of which issued to C. H. PAJEAU on Jun. 27, 1933 and Jul. 4, 1933, respectively. These patents disclose the original "Tinker Toy" building block system, which includes an assortment of relatively inter-fitting elements of varying types that are adapted to be manually assembled into structures and mechanisms of widely varying sizes and types. This invention is somewhat limited in what may be built with the elements.

Still another example of the prior art is disclosed in U.S. Pat. No. 2,622,335, entitled SECTIONAL TOY FIGURE, which issued Dec. 15, 1953 to G. H. Calverley, The disclosed invention relates to sectional toy figures having inter-engagable construction pieces including bodies, heads, limbs, feet and connecting elements. The joints include a socket in the body piece for interconnection with similarly connecting elements. A key problem with this invention is the same as discussed above. Wear on the elements will cause the pieces not to hold their shape.

Yet another prior art example is disclosed in U.S. Pat. No. 3,286,391, entitled CONSTRUCTION TOY HAVING A VARIABLE ANGLE JOINT, which issued to M. Mengeringhausen on Nov. 22, 1966. This patent discloses another joint mechanism for use with toy construction. The invention includes a relatively small spherical connecting member of elastic material having a plurality of substantially cylindrical holes. Again, a key problem with this invention is the same as discussed above. Wear on the elements will cause the pieces not to hold their shape.

Another example of the prior art is disclosed in U.S. Pat. No. 3,458,949, entitled CONSTRUCTION SET, which issued to G. G. Young on Aug. 5, 1969. This patent discloses a terminal unit of spherical shape including a pair of like interlocking members, each having a plurality of circumferential grooves in it. The side walls of each groove, intermediate the ends of the groove, have transversely opposite cavities which form a ball receiving socket. The construction set disclosed in this patent is somewhat limited in what may be constructed.

Many other examples of the prior art are illustrated in issued such U.S. Pat. No. as 3,510,979, entitled ASSEMBLY KIT, which issued May 12, 1970 to A. Fischer; U.S. Pat. No. 3,747,261, entitled BALL AND ROD LINKAGE FOR JOINING POLYHEDRAL MEMBERS, which issued Jul. 24, 1973 to Nast Salem; U.S. Pat. No. 4,037,978, entitled RESILIENT SWIVEL CONNECTOR, which issued Jul. 26, 1977 to Brian W. Connelly; U.S. Pat. No. 4,078,328, entitled CONSTRUCTION TOY SET, which issued Mar. 14, 1978 to Larry W. Rayment; U.S. Pat. No. 5,897,417, entitled CONSTRUCTION SYSTEM, which issued Apr. 27, 1999 to Michael J. Grey; and, U.S. Pat. No. 6,264,522 B1, entitled CONSTRUCTION SYSTEM, which issued Jul. 24, 2001 to Marilyn M. Dickson.

What is needed is a toy construction system having a connector/spinner device that allows the interconnection of a large variety of components in a large variety of structures or formations in order to foster child development of dexterity and creativity.

SUMMARY OF THE INVENTION

As will be amplified in greater detail hereinbelow, the present invention solves one of the prior art problems by providing a connector/spinner device that is rotatable and may connect to a wide variety of components.

Accordingly, it is an object of the present invention to provide a toy construction system that will foster child development of dexterity and creativity.

Another object of the present invention is to provide a toy construction system capable of assembling a wide variety of structures or formations.

Yet another object of the present invention is to provide a toy construction system with a rotatable connector/spinner device that connects to a wide variety of components.

These and other objects, which will become apparent as the invention is described in detail below, wherein a toy construction system is provided that includes, in a toy construction system having a multiplicity of interconnecting members adapted for constructing a variety of projects, a rotator head device including a device housing having a conical-shaped cavity formed therein. The housing includes a plurality of female twist-lock connectors formed on the outer surface thereof, and the female connectors are adapted for attaching a first member of the toy construction system to the rotator head device housing. A rotating member, which is conical in shape and slightly smaller in size than the cavity formed in the device housing is included. The rotating member is rotatably disposed within the cavity and has a male twist-lock connector stem extending from an end thereof for connecting a second member of the toy construction system to the rotating member, whereby the first member is rotatable with respect to the second member.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which the drawings form a part of this application.

DETAILED DESCRIPTION OF ONE EMBODIMENT

Figure 1:
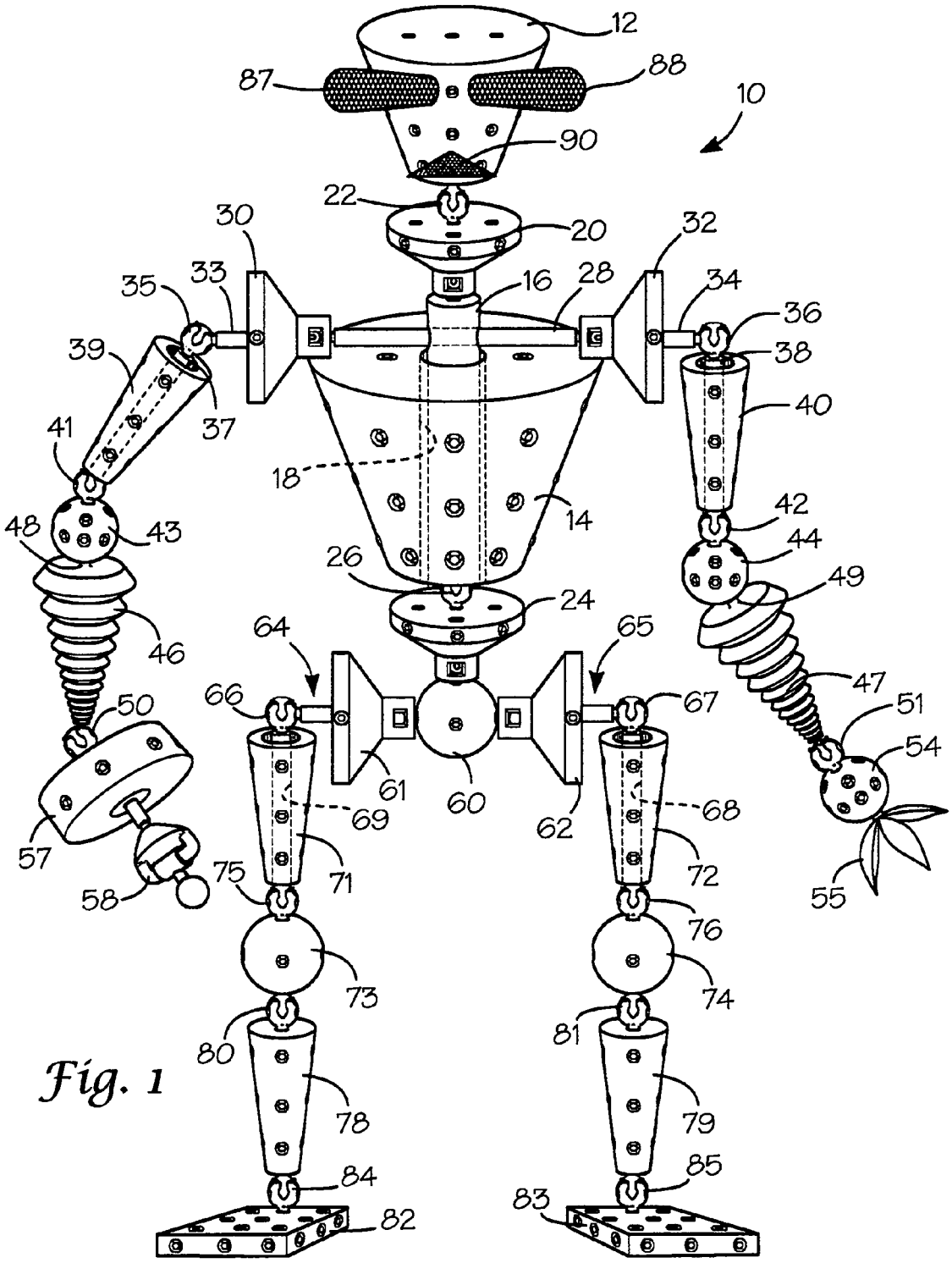
FIG. 1 is a perspective view of a child's imaginary robot assembled with the novel elements of the present invention.

Referring now to the drawings and to FIG. 1 in particular, a perspective view of an imaginary robot 10 assembled with the novel construction elements of the present invention is shown. The robot's head and chest are fashioned from rotatable joint members 12 and 14, respectively. A dowel block 16 is disposed through a center shaft 18 of the joint member 14, with one end thereof coupled to another rotatable member 20 at the neck of the robot 10. A flexible connector 22, as described in further detail in my co-pending patent application (Ser. No. 11/446,778), connects the head member 12 with rotatable member 20, which connects to one end of the dowel 16 by means of a twist-lock connector. The other end of the dowel block 16 is coupled to yet another rotatable member 24 by means of another flexible connector 26.

Another, yet smaller, dowel block 28 is threaded through an opening near the first end of the dowel 16 for connecting a pair of rotatable members 30 and 32 that fashion the shoulders of the robot 10. Female/male connectors 33 and 34 are attached to the members 30 and 32, respectively, for further attachment to flexible connectors 35 and 36, which secure the upper arms of the robot 10. Dowel blocks 37 and 38 are attached to the flexible connectors 35 and 36, respectively, and are then threaded through rotatable members 39 and 40, which fashion biceps for the robot 10. Additional flexible connectors 41 and 42 are coupled to the second end of the dowel blocks 37 and 38, which are further coupled to compound connector blocks 43 and 44, which act as elbows of the robot 10.

The forearms of the robot are formed by a pair of stretch specialty head devices 46 and 47 coupled to the elbow compound connector blocks 43 and 44 by twist-lock connectors 48 and 49, respectively. The second end of the stretch specialty head devices 46 and 47 are coupled to flexible connectors 50 and 51. At this juncture, the user may select a variety of elements to form the hands of the robot 10. For example, the robot's left hand is formed by a compound connector block 54 coupled to the flexible connector 51 and a specialty part 55 coupled to the ball connector 54 to simulate fingers. Specialty parts are something not recognizable as distinct and separate in itself until attached to other parts of the system. The right hand of the robot 10 may be formed by a rotatable spinner device 57 coupled to the flexible connector 50, and the fingers may be formed by a conically terminated pivot head device 58 coupled to the spinner device 57. It is noted that a female connector device (as shown in FIG. 4*c* hereof) may be used to make this connection.

The pelvic structure of the robot 10 is formed by a compound connector block 60 coupling together the rotatable element 24 with a pair of diametrically opposed rotatable elements 61 and 62. Male/female connectors 64 and 65 are coupled to the elements 61 and 62, respectively, and to flexible connectors 66 and 67. The flexible connectors are also coupled to one end of dowel blocks 68 and 69, which are threaded through rotatable elements 71 and 72, respectively. The second end of the dowel blocks 68 and 69 are coupled to compound connector blocks 73 and 74, which function as knees of the robot 10, by means of flexible connectors 75 and 76.

The lower legs are formed by a pair of conical blocks 78 and 79, each having a first end coupled to the compound connector blocks 73 and 74 by a pair of flexible connectors 80 and 81, respectively. The second end of the blocks 78 and 79 are coupled to a pair of panels 82 and 83, which function as the feet of the robot 10, by means of flexible connectors 84 and 85.

Finally, the face of the robot 10 may be fashioned by adding a pair of specialty parts 87 and 88 to form goggles/glasses and another specialty part 90 to form the mouth.

It is pointed out that the afore-described robot 10 is just an example of what one can assemble with the novel elements of the present invention. The description set forth hereinbelow amplifies these elements in greater detail.

Figure 2:
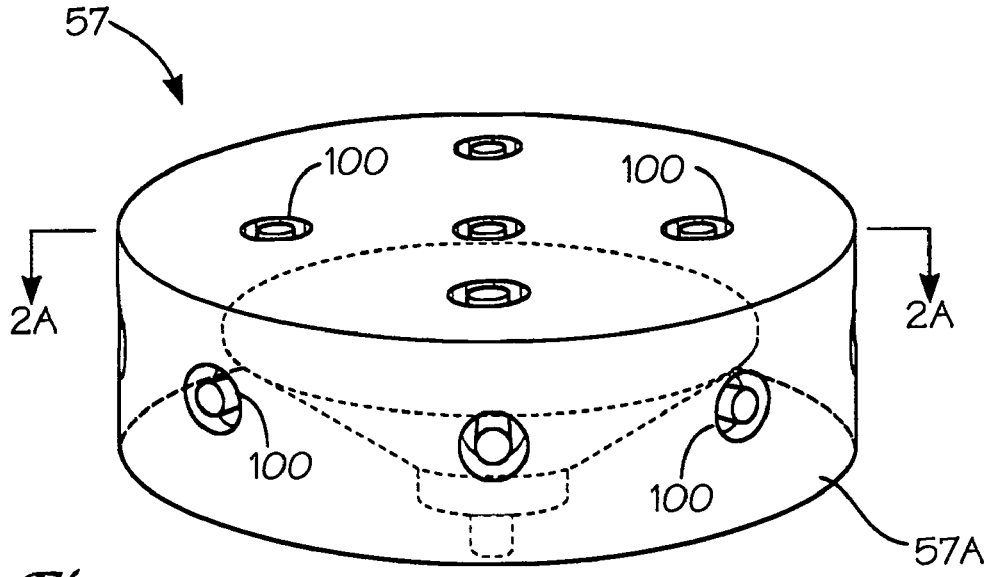
FIGS. 2 and 2A illustrate details of the rotator head of the present invention.
Figure 2A:
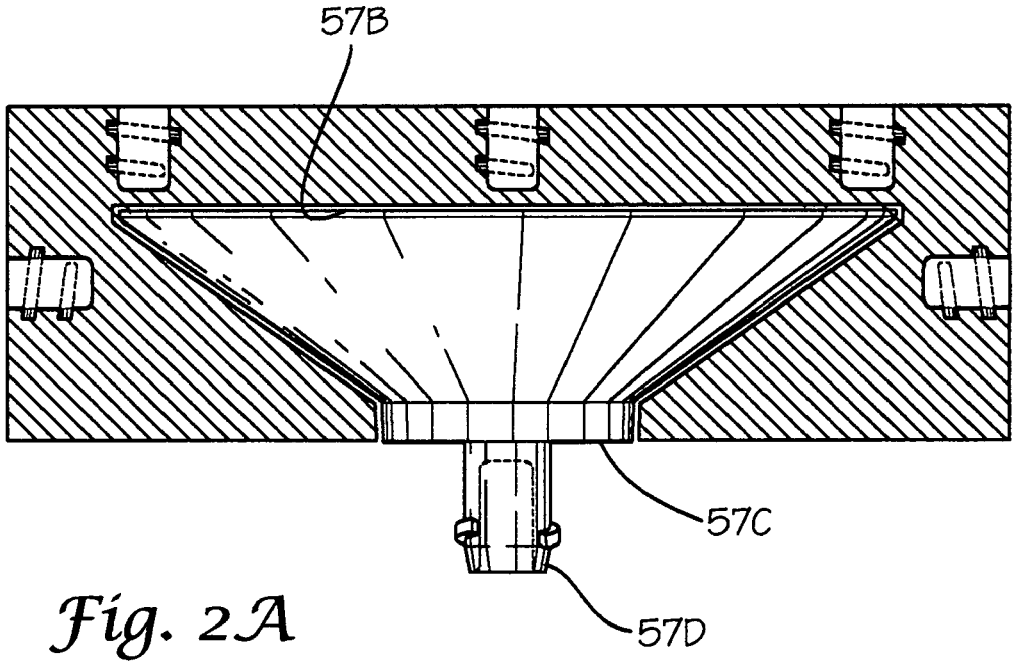

Referring now to FIGS. 2 and 2A, a perspective view and a cross-sectional view, respectively, of the rotatable spinner device 57 is shown. The cross-sectional view of FIG. 2A is taken along section line 2A-2A, as shown in FIG. 2. The device 57 is formed of two parts, an outer cylinder 57A having a hollow interior 57B, and a center piece 57C that fits within the interior 57B and is free to rotate freely therein. A multiplicity of twist-lock sockets 100 are formed on the outer surface of the outer cylinder 57A for connection of other parts of the system as will be described further hereinafter and is described in detail in my co-pending patent application entitled TOY CONSTRUCTION SYSTEM HAVING A VARIABLE ANGLE JOINT. The center piece 57C includes a male twist-lock stem 57D, which is used to connect the joint 57 to twist-lock sockets, such as sockets 100, for addition of the device 57 to other parts of the system.

Figure 3:
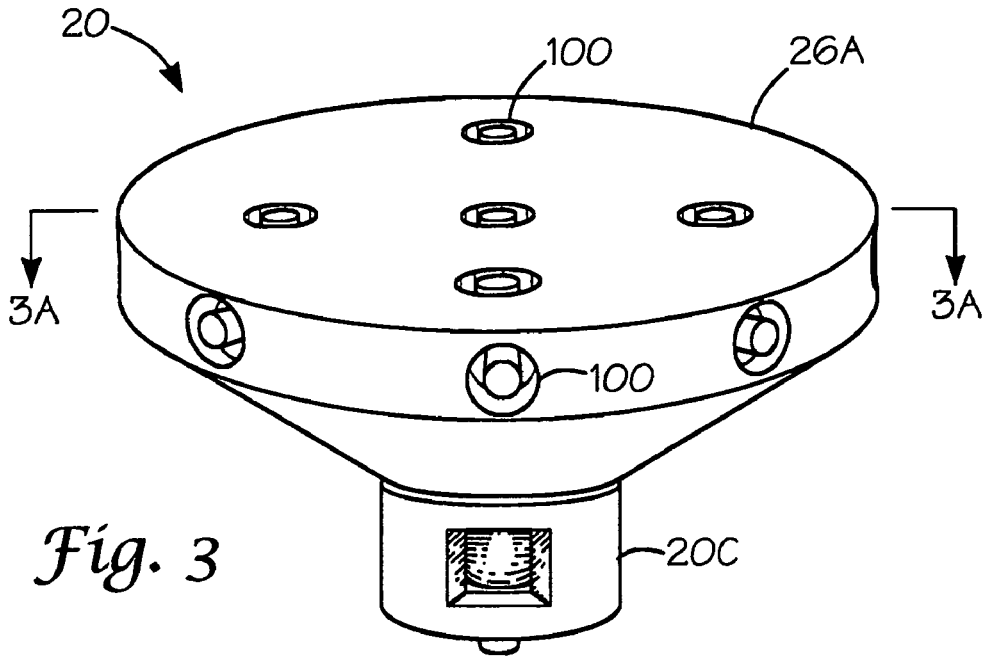
FIGS. 3 and 3A illustrate details of an alternate embodiment of a rotator head of the present invention.
Figure 3A:
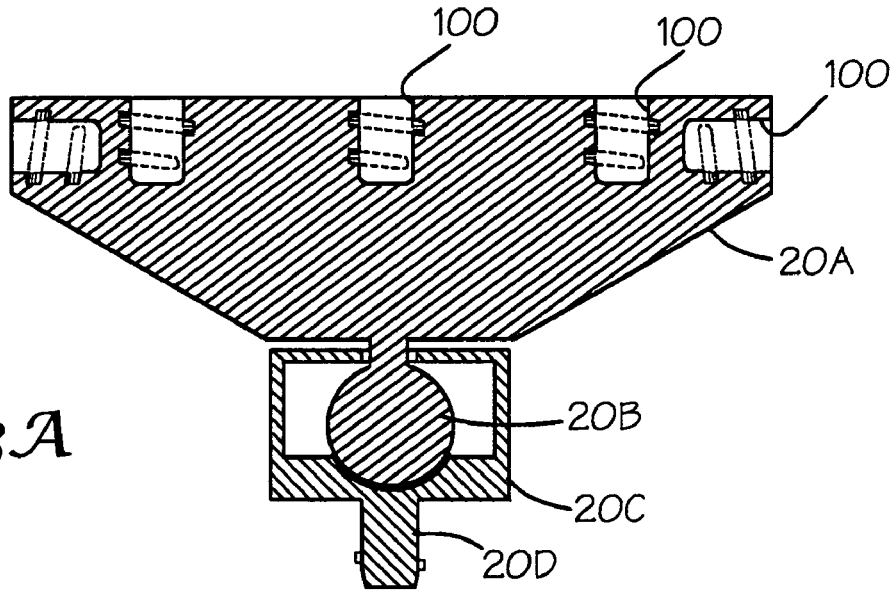

Referring now to FIGS. 3 and 3A, a perspective view and a cross-sectional view, respectively, of the spinner device 20 is shown, which device is an alternate embodiment of the device 57. The cross-sectional view of FIG. 3A is taken along the line 3A-3A as shown in FIG. 3. The device 20 comprises a rotatable conical-shaped part 20A having an extended ball-shaped projection 20B on one side thereof, and a receptacle 20C disposed for receiving the ball-shaped projection 20B. Also, the conical-shaped part 20A has formed in the surfaces thereof a multiplicity of the twist-lock sockets 100. It is pointed out that the part 20A may also have other shapes than a cone. The sockets 100 are disposed for connection of other parts of the system as will be described further hereinafter and is described in detail in my co-pending patent application entitled TOY CONSTRUCTION SYSTEM HAVING A VARIABLE ANGLE JOINT. The receptacle 20C includes a male twist-lock stem 20D, which is used to connect the spinner device 20 to other parts of the system.

Figure 4:
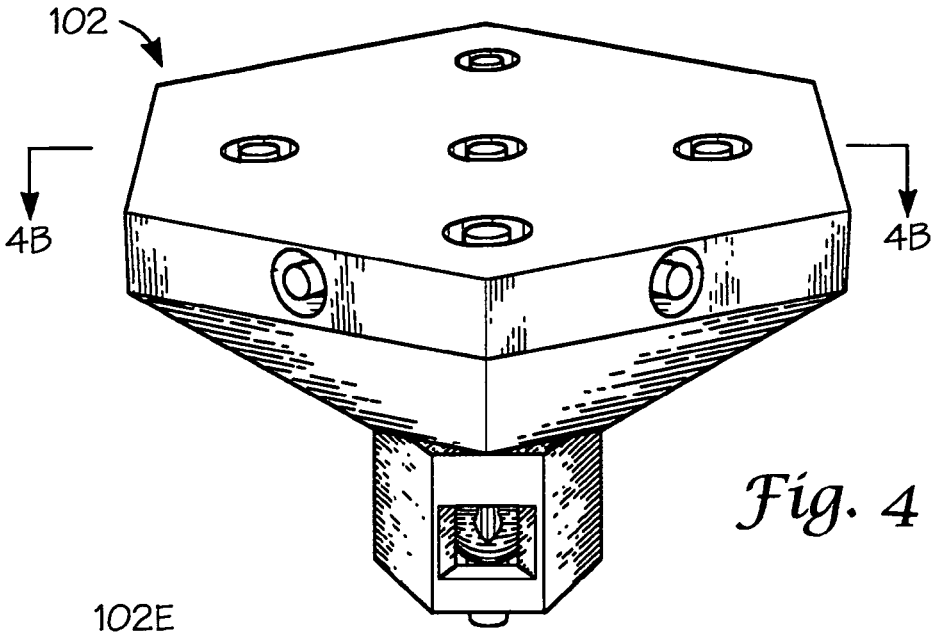
FIGS. 4, 4A and 4B illustrate details of another embodiment of a rotator head of the present invention.
Figure 4A:
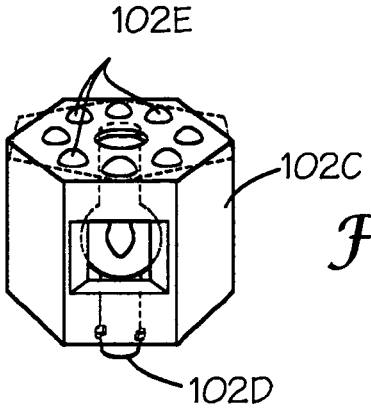
Figure 4B:
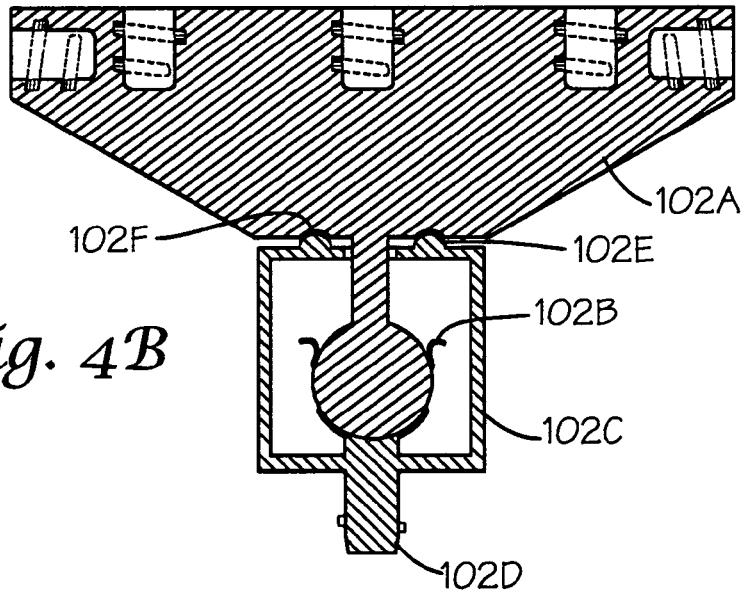

Referring now to FIGS. 4, 4A and 4B, perspective views and a cross-sectional view, respectively, of yet another embodiment 102 of the rotatable spinner device 20 is shown. In this embodiment, the top part 102A (which is the rotating part) is attached to and held in place by a socket 102B, which is housed within a receptacle body 102C. The receptacle body 102C includes a male twist-lock stem 102D, which is used to connect the device 102 to other parts of the system. The socket 102B biases the top part 102A against the top surface of the receptacle body 102C, which includes a plurality of dents 102E that mate with an identical plurality of indents 102F in the underside of the top part 102A. Accordingly, the top part 102A may be pulled away from the socket 102B, but is restrained within the receptacle body 102C. The top part 102A may then be twisted to a new position and snapped back into the socket 102B, which biases the two parts together. The socket 102B may be the same as the flexible connector 22 described hereinabove. It is noted that parts 102A and 102C may have other shapes than those depicted in FIGS. 4, 4A and 4B, though not preferred.

Figure 5:
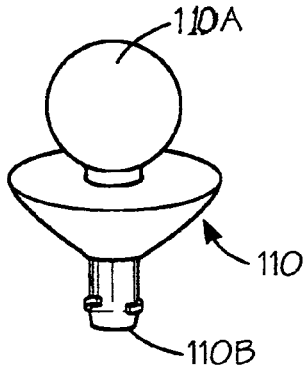
FIGS. 5 and 5A illustrate details of simple spinner block head devices.
Figure 5A:
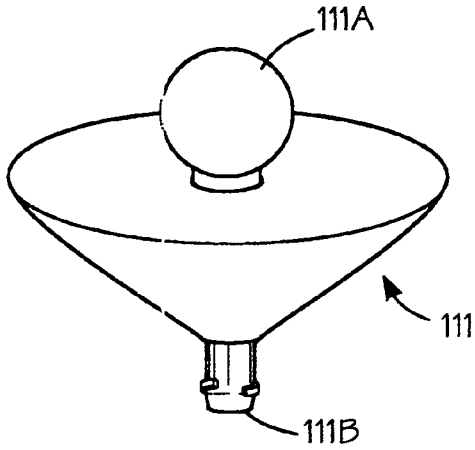

Referring now to FIGS. 5 and 5A, a pair of simple conically terminated head devices 110 and 111 are shown, respectively. Each device includes a spherical connector 110A/111A on one end thereof, and on the opposite end thereof a twist-lock stem 110B/111B, which allows connection to other parts of the system. The spherical connectors 110A/111A are sized to fit in one of the flexible connectors 22, as described hereinabove. It is noted that the spherical connectors 110A/111A may comprise a socket for receiving a spherical connector on another part of the system.

Figure 6A:
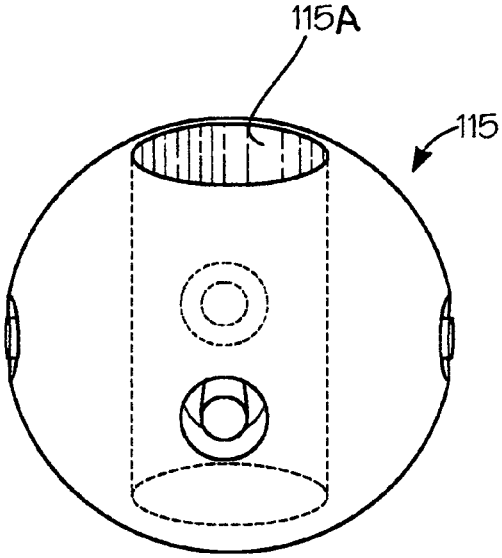
FIGS. 6A and 6B illustrate a spherical spindle adapted for assembly onto a shaft and having one or more twist-lock connectors formed therein.
Figure 6B:
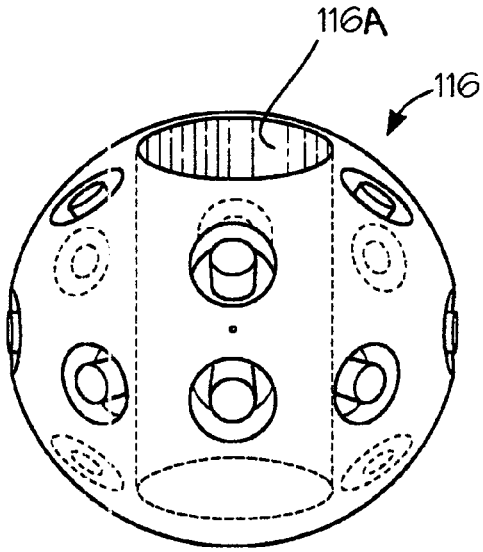

A pair of compound connector blocks 115 and 116 are shown in FIGS. 6A and 6B, respectively. Each block includes a central shaft 115A and 116A formed therethrough. Note that the blocks 115 and 116 are also referred to herein as spinner blocks. Moreover, the blocks 115 and 116 include a plurality of twist-lock connectors 100 formed around the surface thereof. This allows connection of other parts of the system to these blocks. Compound connector blocks, such as the blocks 115 and 116, may be of any shape and may not include a central shaft; or, they may be hollow or solid.

Figure 7A:
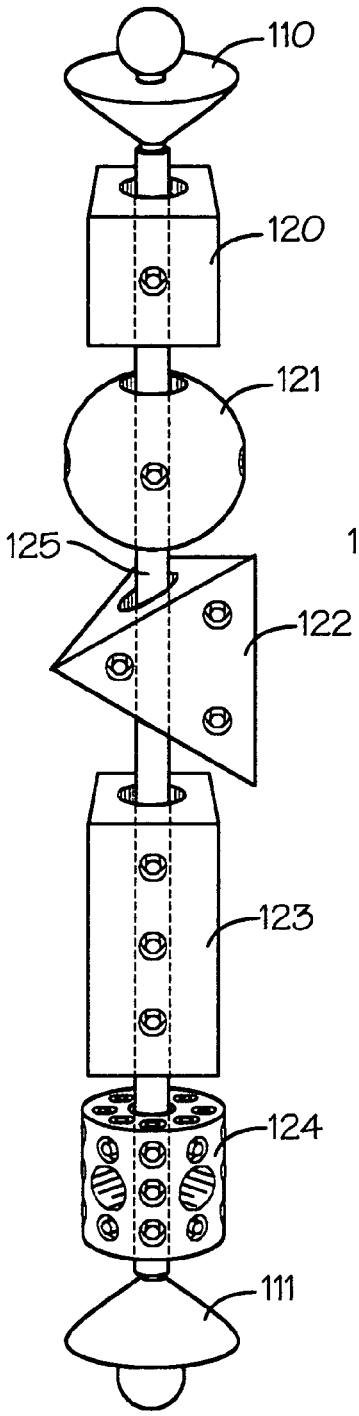
FIG. 7A illustrates a toddler's toy having a multiplicity of block rotatably mounted onto a shaft.
Figure 7B:
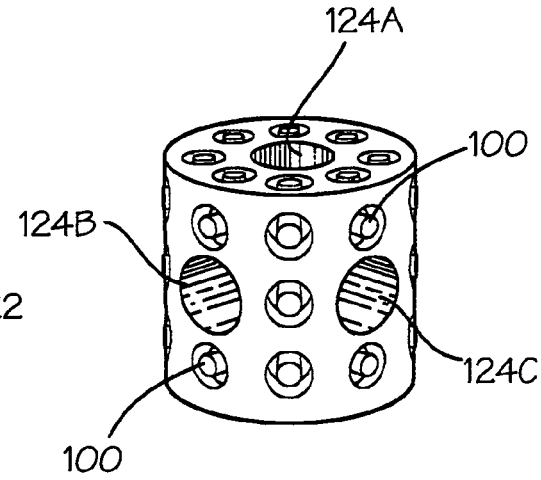
FIG. 7B illustrates a compound connector block having spindle shafts formed therethrough and a multiplicity of twist-lock connectors formed therein.

Referring now to FIG. 7A, a toy assembly is illustrated, which assembly is made up of a plurality of spinner blocks 120 through 124 threaded onto a dowel 125. The end devices 110 and 111 are connected to either end, respectively, of the dowel 125 to retain the blocks 120 through 124 thereon. Each of the blocks 120 through 124 may rotate about the dowel 125. Other parts of the system may be connected to the blocks 120 through 124 to construct a variety of toys for toddlers. FIG. 7B illustrates the cylindrical-shaped block 124 in greater detail. Note that there are three shafts 124A, 124B and 124C formed through the part 124, each being perpendicular to the other. This allows threading this part onto the dowel 125 in a variety of orientations. It is noted that shafts may be formed in any number, and location on a specific block. A spinner block will have at least one central shaft.

Figure 8A:
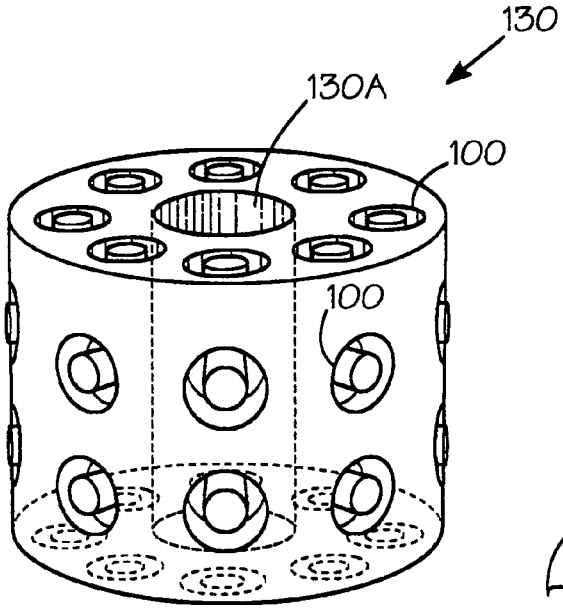
FIGS. 8A and 8B illustrate a pair of cylindrical rotatable blocks having a spindle shaft formed therethrough and a multiplicity of twist-lock connectors formed therein.
Figure 8B:
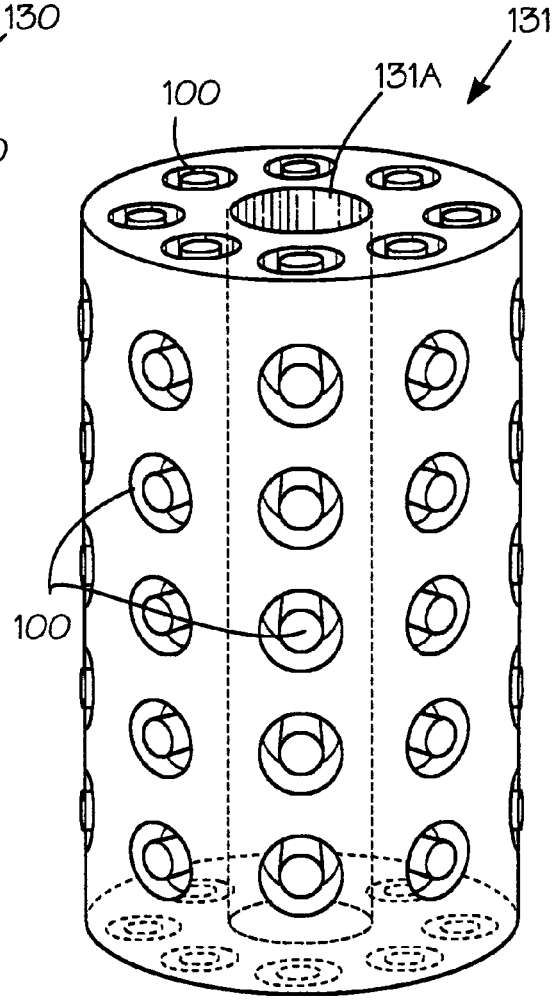

Referring now to FIGS. 8A and 8B, a pair of spinner blocks 130 and 131, respectively, are illustrated. Center shafts 130A and 131A are formed through each of the blocks 130 and 131, respectively. A multiplicity of twist-lock connectors are formed on the outer surface of each of the blocks 130 and 131 for connection of additional elements of the system.

Figure 9A:
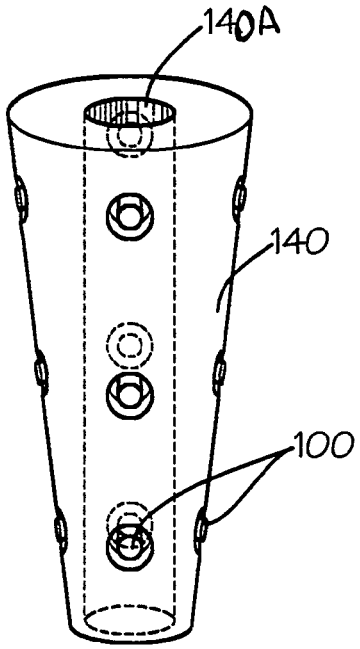
FIGS. 9A and 9B illustrate a pair of conical shaped rotatable blocks having a shaft formed therethrough and a multiplicity of twist-lock connectors formed therein.
Figure 9B:
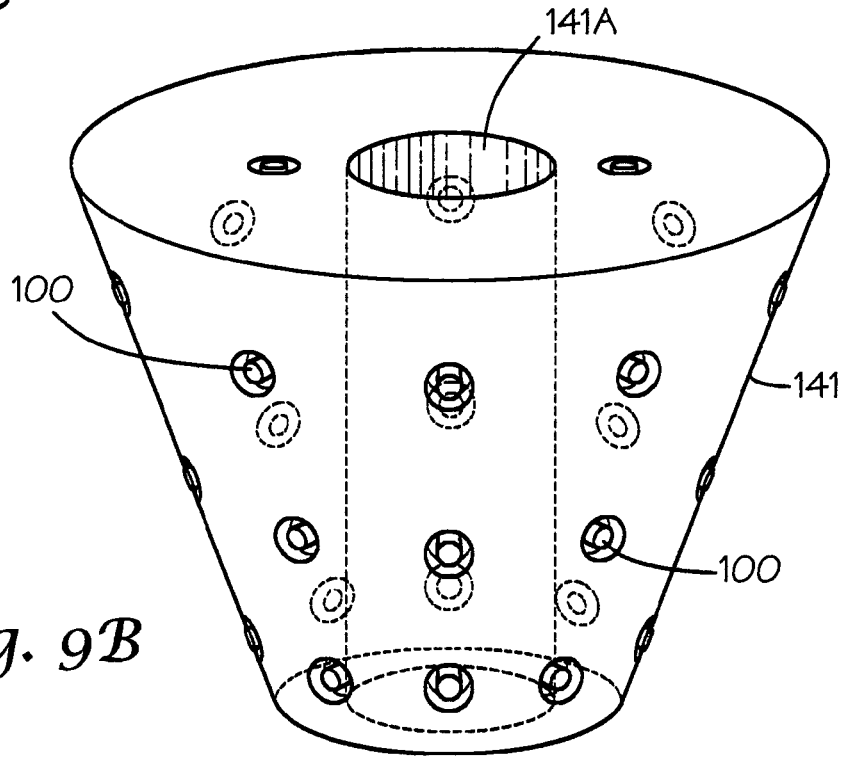

Referring now to FIGS. 9A and 9B, a pair of cylindrical-conical spinner blocks 140 and 141, respectively, are illustrated. Center shafts 140A and 141A are formed through each of the blocks 140 and 141, respectively. A multiplicity of twist-lock connectors are formed on the outer surface of each of the blocks 140 and 141 for connection of additional elements of the system. The blocks 140 and 141 are useful in assembling the robot 10 shown in FIG. 1. For example, the torso 14, the upper arms 39 and 30, the thighs 68 and 69 are formed by blocks such as the blocks 140 and 141.

Figure 10A:
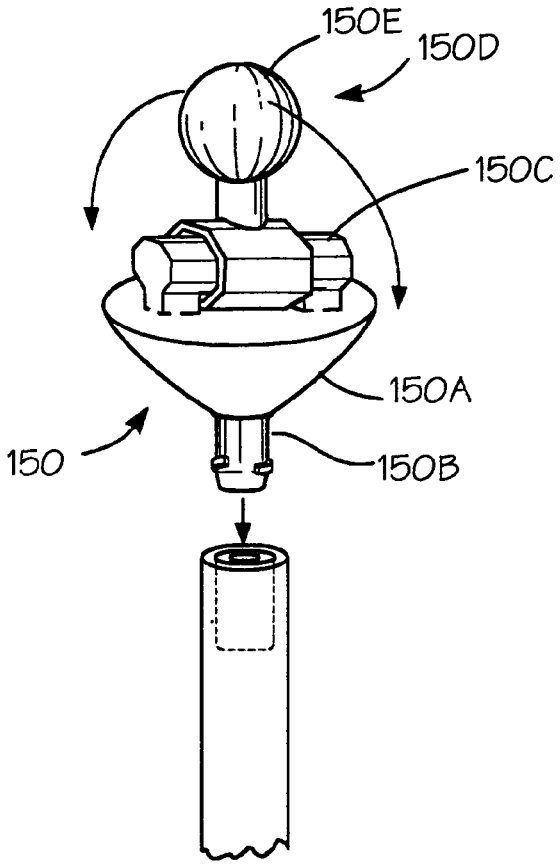
FIGS. 10A and 10B illustrate a pair of conically terminated pivot head devices that may be assembled onto other devices by a twist-lock connector.
Figure 10B:
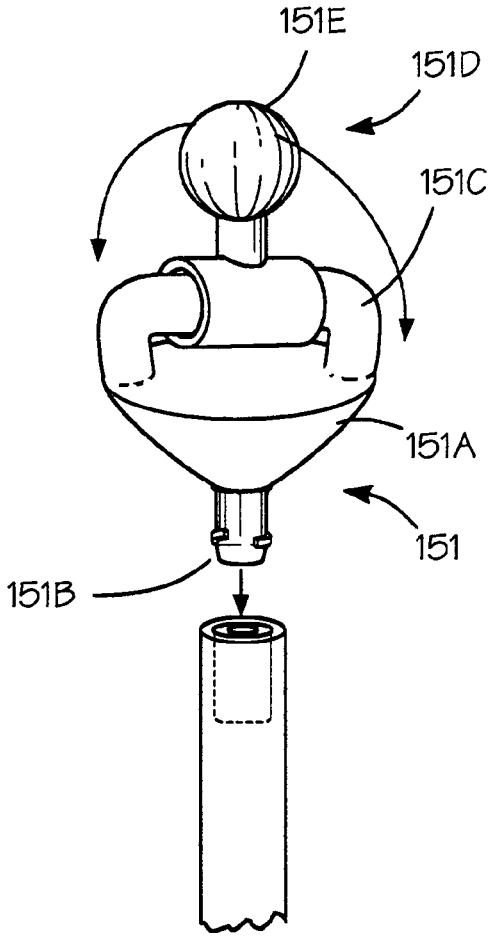

Referring now to FIGS. 10A and 10B, a pair of conically terminated pivot head devices 150 and 151, respectively, are illustrated. Device 150 (FIG. 10A) has a conical shaped body 150A and a stem 150B at the narrow end thereof for attachment to other elements of the toys construction system. Attached to the opposite end of the device 150 is a stirrup 150C, which supports a pivot head 150D. The pivot head 150D is free to rotate in the directions of the arrows shown in FIG. 10A. A sphere 150E is attached to the pivot head 150D, which is sized and adapted for attachment to a flexible connector 22 of the toy construction system. It is noted that a socket may also be formed on the pivot head 150D in lieu of the sphere 150E.

Device 151 (FIG. 10B) has a conical shaped body 151A and a stem 151B at the narrow end thereof for attachment to other elements of the toys construction system. Attached to the opposite end of the device 151 is a stirrup 151C, which supports a pivot head 151D. The pivot head 151D is free to rotate in the directions of the arrows shown in FIG. 10B. A sphere 151E is attached to the pivot head 151D, which is sized and adapted for attachment to a flexible connector 22 of the toy construction system. It is noted that a socket may also be formed on the pivot head 151D in lieu of the sphere 151E. The difference between the pivot head 150 and 151, as shown in the figures, is that the stirrup 150C of the head 150 is faceted while that of the device 151 is smooth. This allows the pivot head 150 to be affixed in a plurality of fixed angles, while the pivot head 151 may be set at any number of angles.

Figure 11:
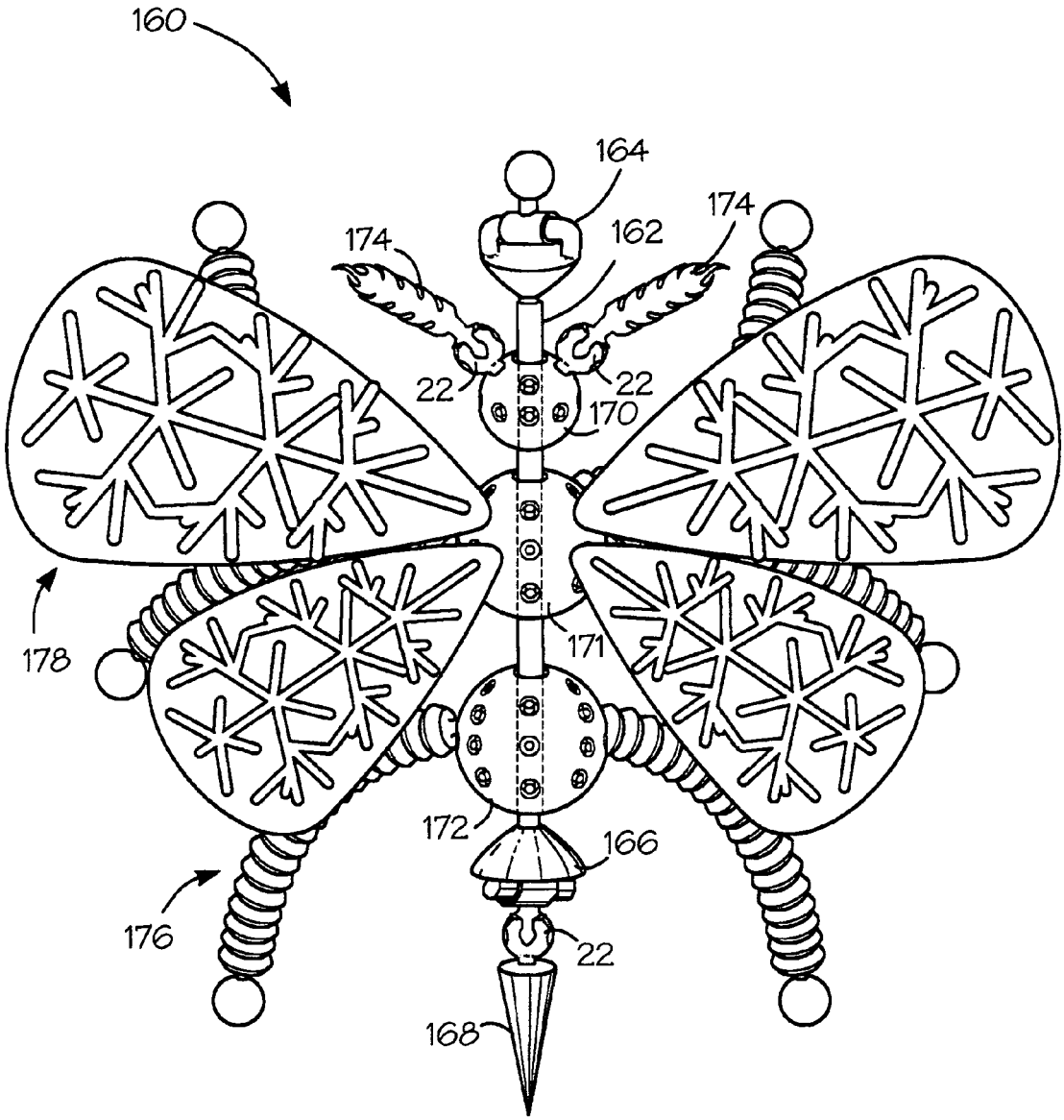
FIG. 11 illustrates a fantasy insect as an example of an object one can assemble with the system of the present invention.

Referring now to FIG. 11, a fantasy insect 160 is illustrated as an example of an object one can assemble with the system of the present invention. A dowel 162 is used to form the central body of the insect with a pivot head 164 attached to one end of the dowel to form the insect's head. A second pivot head 166 and a flexible connector 22 attached to a specialty cone part 168 form the tail of the insect 160. Spherical spindles 170, 171 and 172 are threaded onto the dowel 162 and further enhance the body of the insect 160. Antennae 174 are attached to the sphere 170 by means of flexible connectors 22. Legs 176 are formed of stretch heads and attached to the spheres 171 and 172. Wings 178 of the insect are formed of parts and also attached to the sphere 171.

Although the invention has been described with reference to a specific embodiment, this description is not meant to be construed in a limiting sense. Various modifications of the disclosed embodiment as well as alternative embodiments of the invention will become apparent to one skilled in the art upon reference to the description of the invention. It is therefore contemplated that the appended claims will cover any such modifications of embodiments that fall within the true scope of the invention.

What is claimed is:

1. A toy construction system having a multiplicity of interconnecting members adapted for constructing a variety of projects, a spinner device comprising:

a. a body formed about a longitudinal axis of said spinner device and having a first end, and a second smaller end opposite said first end, said first end and said second end being aligned along said longitudinal axis, said second smaller end having a plurality of indents disposed around a periphery thereof;

b. a ball connector extending outwardly from said body along said longitudinal axis;

c. a receptacle member, separate from said body, having a hollow body and including a separate deflectable socket within said hollow body and adapted for receiving said ball connector extending from said body, wherein said ball connector nesting in said socket form a ball and socket joint such that said ball connector is free to spin within said hollow body about said longitudinal axis;

d. said receptacle member further including a plurality of dents disposed around a periphery of a first surface for mating with said indents on said second smaller end of said body, whereby said deflectable socket biases said body against said receptacle member such that said indents engage said dents so as to maintain a given angular position of said body with respect to said receptacle member; and, e. a male twist-lock connector extending outwardly from a second surface of said receptacle member opposite said first surface and being disposed along said longitudinal axis for connecting said spinner device to other components of said toy construction system.

2. A spinner device as in claim 1 wherein said body is hexagonal in cross section.

3. A spinner device as in claim 2 wherein said receptacle member is hexagonal in cross section.

4. A spinner device as in claim 1 wherein said body is conical shaped and circular in cross section.

5. A spinner device as in claim 4 wherein said receptacle member is conical shaped and circular in cross section.

6. A spinner device as in claim 1 wherein said hollow body surrounds said separate deflectable socket to allow said ball to be removed from said socket while still being restrained inside the hollow body of said receptacle member.

7. A toy construction system having a multiplicity of interconnecting members adapted for constructing a variety of projects, a spinner device comprising:

a. a body formed about a longitudinal axis of said spinner device and having a first end, and a second end opposite said first end, said first end and said second end being aligned along said longitudinal axis, said second end having a plurality of indents disposed around a periphery thereof;

b. a ball connector extending outwardly from said body along said longitudinal axis;

c. a receptacle member, separate from said body, having a hollow body and including a separate deflectable socket within said hollow body and adapted for receiving said ball connector extending from said body, wherein said hollow body is of sufficient size so as to surround said separate deflectable socket and allow said ball connector to be removed from said socket while still being restrained inside the hollow body of said receptacle member;

d. said receptacle member further including a plurality of dents disposed around a periphery of a first exterior surface thereof for mating with said indents on said second end of said body, whereby said deflectable socket biases said body against said receptacle member such that said indents engage said dents so as to maintain a given angular position of said body with respect to said receptacle member; and, e. a male twist-lock connector extending outwardly from a second exterior surface of said receptacle member opposite said first surface and being disposed along said longitudinal axis for connecting said spinner device to other components of said toy construction system.

8. A toy construction system having a multiplicity of interconnecting members adapted for constructing a variety of projects, an adjustable angular spinner device comprising:

a. a body formed about a longitudinal axis of said spinner device and having a first end, and a second end opposite said first end, said first end and said second end being aligned along said longitudinal axis, said second end having a plurality of indents disposed around a periphery thereof;

b. a ball connector extending outwardly from said body along said longitudinal axis;

c. a receptacle member, separate from said body, having that form a hollow body and including a separate deflectable socket formed within hollow body adapted for receiving said ball connector extending from said body, wherein said hollow body is formed large enough to surround said separate deflectable socket and allow said ball connector to be removed from said socket and still be restrained inside the hollow body of said receptacle member;

d. said receptacle member further including a plurality of dents disposed around a periphery of a first exterior surface thereof for mating with said indents on said second end of said body, such that when said ball connector is nested within said deflectable socket said body is biased against said receptacle member such that said indents engage said dents in order to maintain a given angular position of said body with respect to said receptacle member; and, e. a male twist-lock connector extending outwardly from a second exterior surface of said receptacle member opposite said first surface and being disposed along said longitudinal axis for connecting said spinner device to other components of said toy construction system.

* * * * *